US005717405A

United States Patent [19]

Quan

[11] Patent Number: 5,717,405

[45] Date of Patent: Feb. 10, 1998

[54] FOUR-PORT PHASE AND AMPLITUDE EQUALIZER FOR FEED ENHANCEMENT OF WIDEBAND ANTENNA ARRAYS WITH LOW SUM AND DIFFERENCE SIDELOBES

[75] Inventor: Clifton Quan, Arcadia, Calif.

[73] Assignee: Hughes Electronics, Los Angeles, Calif.

[21] Appl. No.: 682,449

[22] Filed: Jul. 17, 1996

[51] Int. Cl.[6] ..... H01Q 3/22; H01Q 3/24

[52] U.S. Cl. ..... 342/373; 342/149; 342/151; 342/154; 333/117; 333/136

[58] Field of Search ..... 342/149, 154, 342/373, 427, 151, 80; 333/117, 120, 127, 128, 136, 161

[56] References Cited

U.S. PATENT DOCUMENTS

| | | | |
|---|---|---|---|
| 3,719,949 | 3/1973 | Hemmi | 343/117 |
| 4,719,465 | 1/1988 | Kuroda | 342/151 |
| 4,734,700 | 3/1988 | Brunner | 342/373 |
| 4,827,270 | 5/1989 | Udagawa et al. | 343/853 |
| 4,849,763 | 7/1989 | DuFort | 342/372 |
| 4,916,410 | 4/1990 | Littlefield | 330/295 |
| 4,989,011 | 1/1991 | Rosen et al. | 342/373 |
| 5,079,527 | 1/1992 | Goldfarb | 333/127 |
| 5,162,804 | 11/1992 | Uyeda | 342/373 |
| 5,506,589 | 4/1996 | Quan et al. | 342/373 |

*Primary Examiner*—Thomas H. Tarcza
*Assistant Examiner*—Dao L. Phan
*Attorney, Agent, or Firm*—Leonard A. Alkov; Wanda K. Denson-Low

[57] ABSTRACT

A four-port transmission line device that processes two incoming RF signals of arbitrary phase and amplitude to output two corresponding RF signals of equal phase and amplitude. Two sets each of two quarter-wave transmission line segments are connected in series between corresponding input and output ports. A short circuit interconnect shorts together the junctions of the two series connected line segments. A resistive element is connected across the two input ports, and another resistive element is connected across the two output ports. The short circuit interconnection forces the combination of the two input signals into one resultant signal at the short circuited junction. Out-of-phase components of the resultant signal are absorbed in the resistor across the input ports. The remaining in-phase components are divided into two outputs signals of equal phase and amplitude. The device is incorporated into the feed networks of linear and two-dimensional monopulse phased arrays to provide reduced difference sidelobe levels.

19 Claims, 6 Drawing Sheets

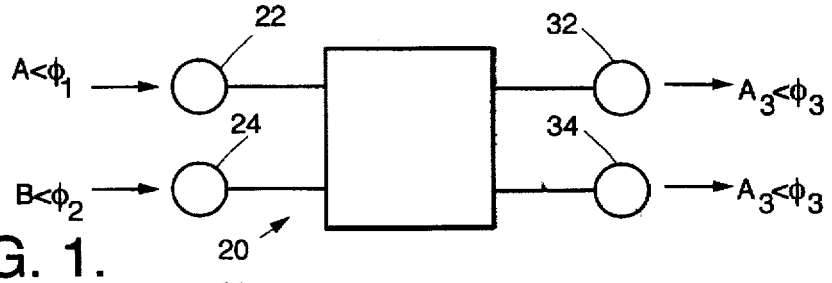
FIG. 1.
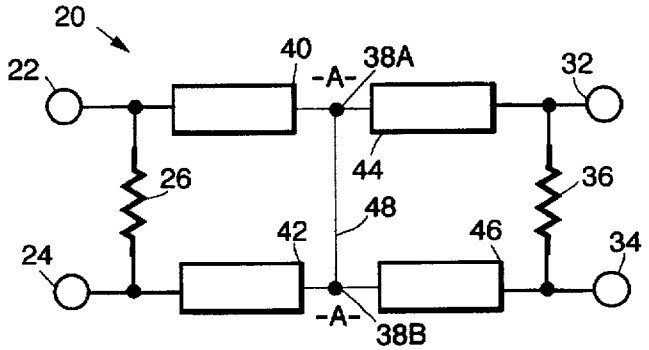
FIG. 2.
FIG. 3.
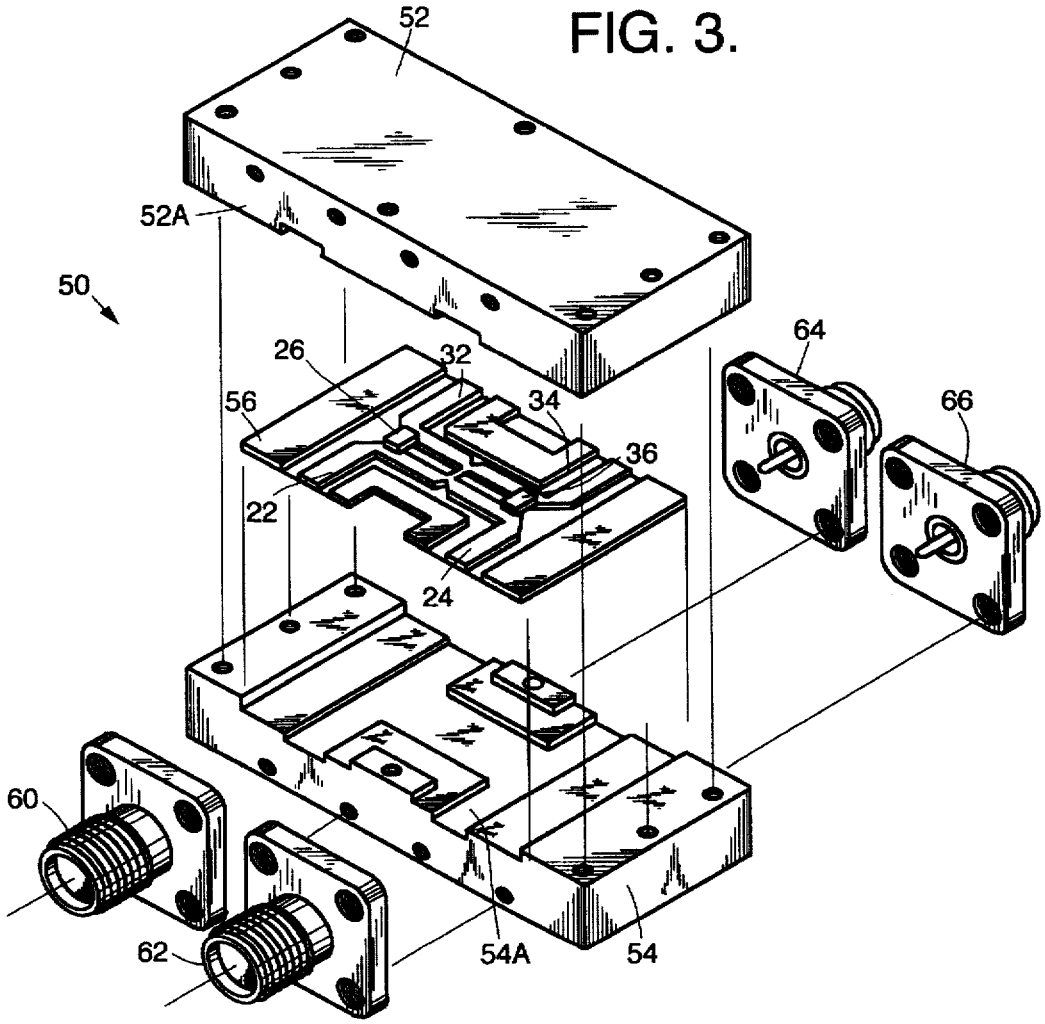

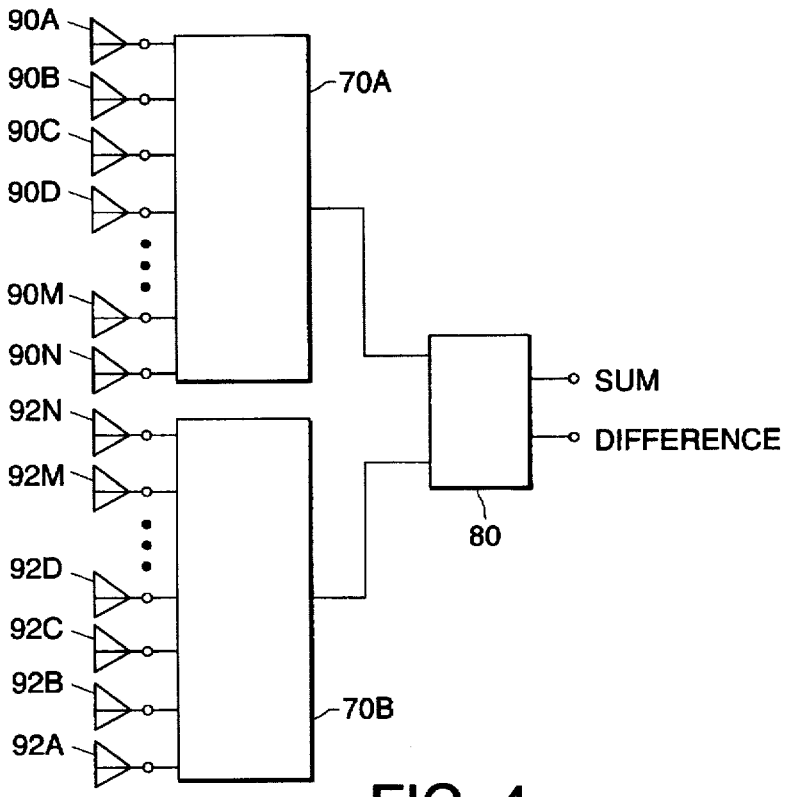
FIG. 4
FIG. 7
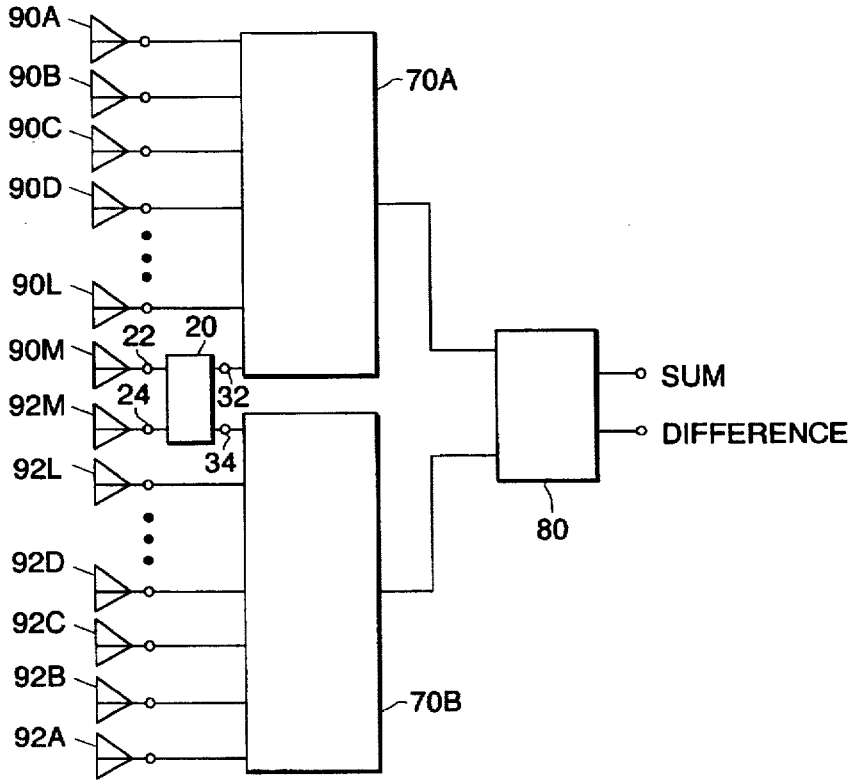

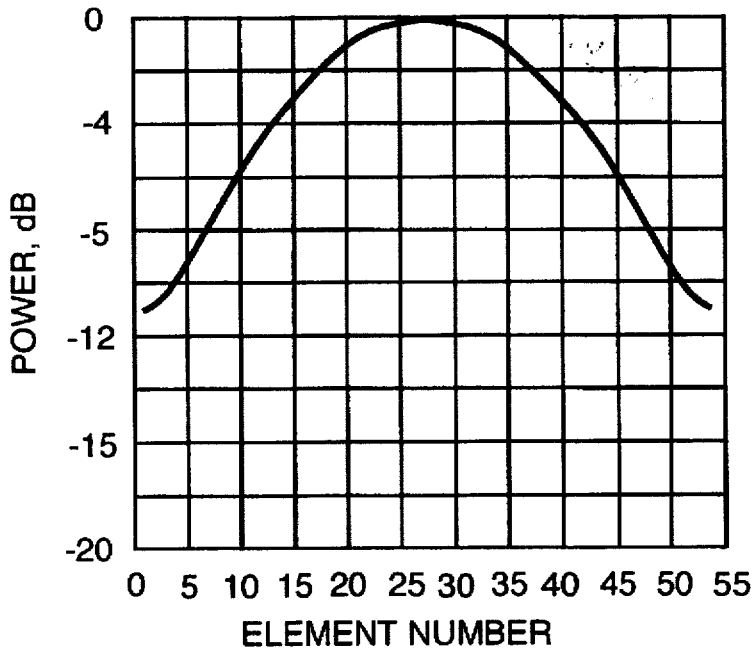
FIG. 5.
FIG. 6.
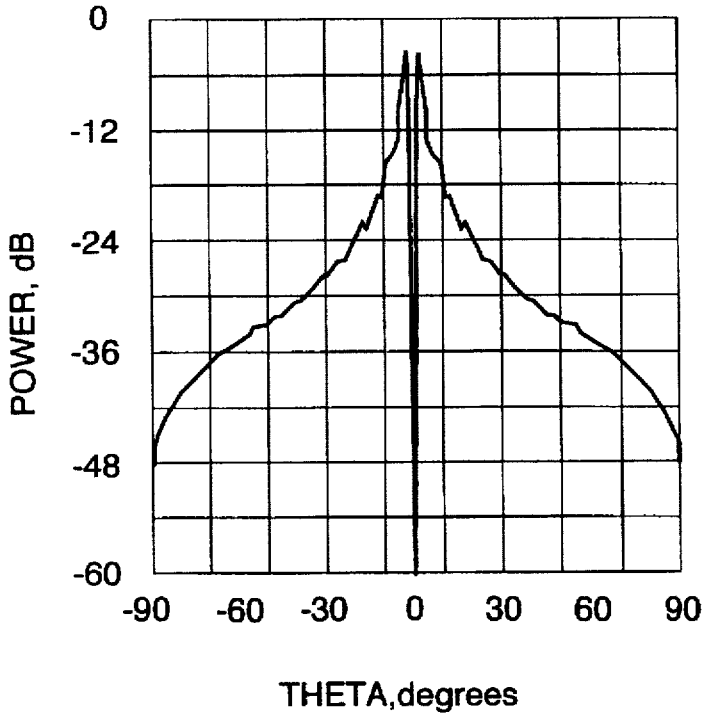

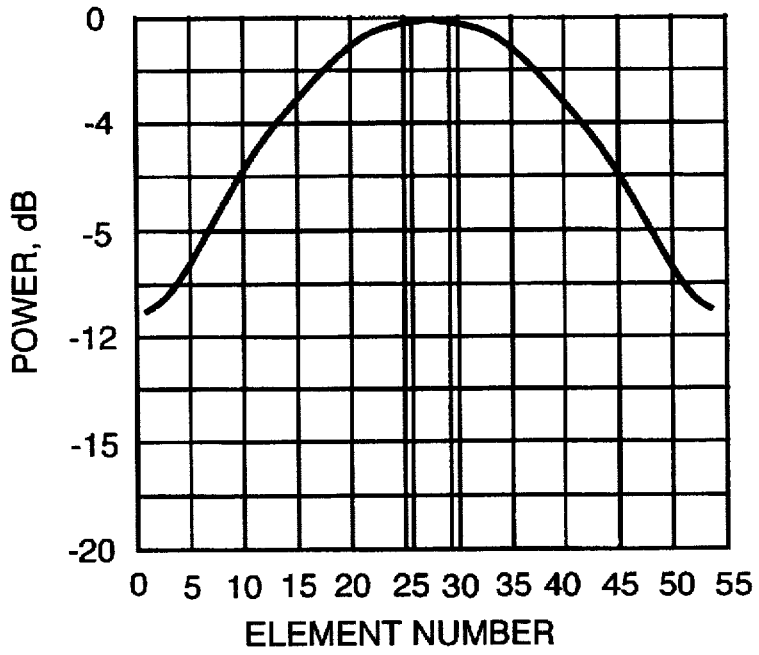
FIG. 8.
FIG. 9.
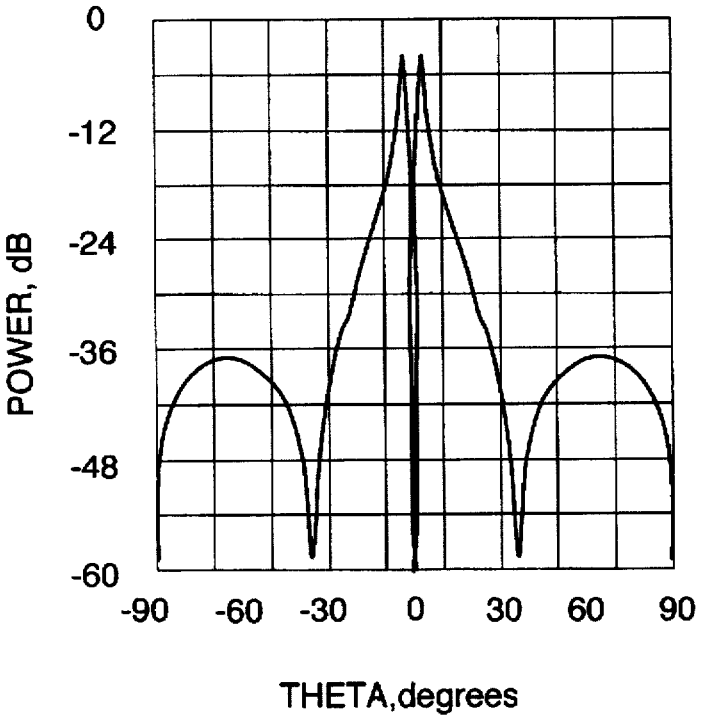

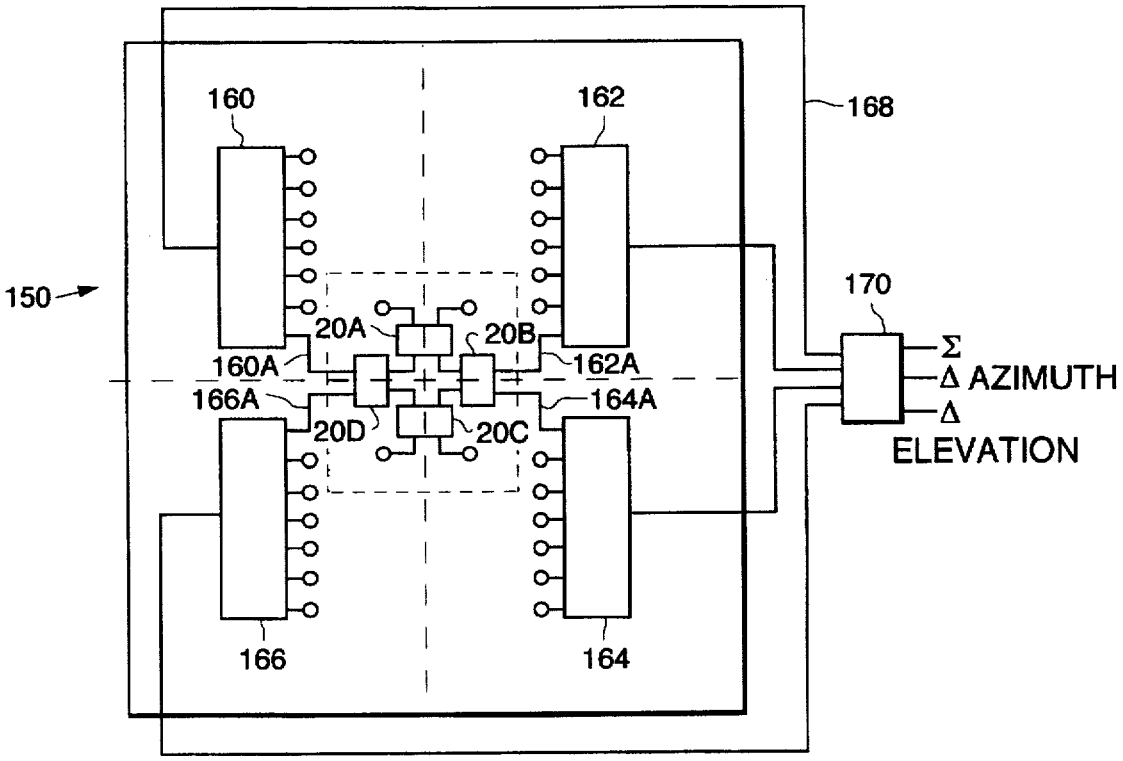
FIG. 11
FIG. 12
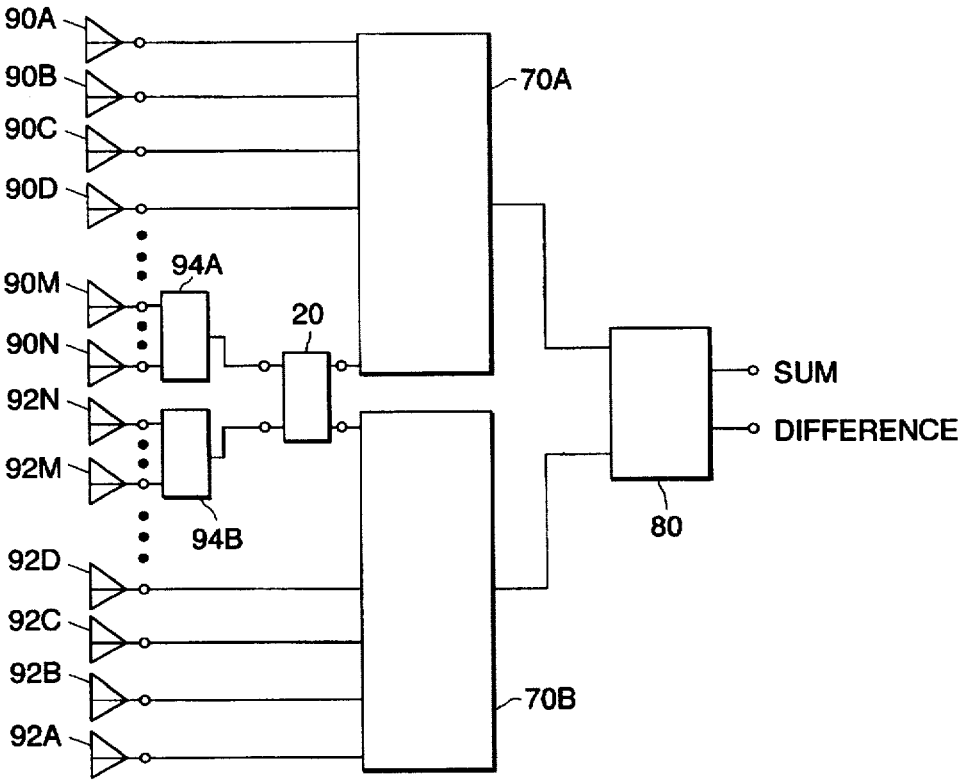

FOUR-PORT PHASE AND AMPLITUDE EQUALIZER FOR FEED ENHANCEMENT OF WIDEBAND ANTENNA ARRAYS WITH LOW SUM AND DIFFERENCE SIDELOBES

TECHNICAL FIELD OF THE INVENTION

This invention relates to RF transmission line devices, and more particularly to a four-port device suitable for incorporation in a monopulse antenna array employing corporate matched feeds.

BACKGROUND OF THE INVENTION

For an antenna array, the RF energy needed to excite the individual radiating elements originates from a single transmitter. The energy is then distributed to all the elements through the antenna feed network. To perform monopulse operation, the feeding of the array is typically split in halves or quadrants, and then the halves or quadrants are combined together with a monopulse network of Magic-T couplers. Such a network will provide an amplitude distribution across the array. However, the monopulse network will create a 180 degree phase change between the two halves of the array at the difference port while maintaining equal phase for the sum port excitation. The results are two entirely different radiation patterns generated by the array. These two patterns are then used by the radar for monopulse tracking. A problem is that the optimal amplitude distribution required to generate a sum pattern with low sidelobes is very different from that required for low difference pattern sidelobes. It is desirable to obtain low sum pattern sidelobes as well as low difference pattern sidelobes.

There have been several approaches to feed networks for monopulse radar arrays. These have suffered from various disadvantages including narrow instantaneous bandwidth, requirements for dual (sum and difference) feeds, complex signal routing and interconnections, non-planar transmission line routing and multi-layer construction. It would be an advantage to provide a reduction in sidelobe levels in monopulse radar systems at relatively low cost in hardware complexity.

SUMMARY OF THE INVENTION

According to one aspect of the invention, a four-port circuit for processing two incoming RF signals of arbitrary phase and amplitude to output two corresponding RF output signals of equal phase and amplitude is described. The circuit comprises first and second input ports for receiving respective first and second incoming RF signals of arbitrary phase and amplitude, and first and second output ports at which first and second output signals are provided. First and second quarter-wavelength transmission line segments are connected at a first junction node and in series between the first input port and the first output port. Third and fourth quarter-wavelength transmission line segments are connected at a second junction node and in series between the second input port and the second output port. A first resistive circuit element is connected between the first and second input ports. A second resistive circuit element is connected between the first and second output ports. A short circuit interconnect electrically connects together the first and second nodes, so that the input signals are combined at the interconnect. The combined input signals divide into first and second signals of equal phase and amplitude which are propagated through the respective second and fourth transmission line segments to the first and second output ports.

In accordance with another aspect of the invention, an antenna array for generating sum and difference monopulse patterns is described, which employs the four port circuit device to achieve low difference sidelobes. In one embodiment, the array includes first and second sets of radiating elements, each set including a plurality of radiating elements, and first and second array feed networks. The first feed network having a first feed output port and a plurality of first feed network radiator ports, the second feed network having a second feed output port and a plurality of second feed network radiator ports. The array further includes a conventional monopulse network for developing sum and difference channel signals. In accordance with the invention, the array includes a four-port circuit having a first input port connected to a first radiating element of the first set and a second input port connected to a second radiating element of the second set, for processing two incoming RF signals of arbitrary phase and amplitude at corresponding radiating elements of the first and second sets to output two corresponding RF output signals of equal phase and amplitude at first and second output ports. The first output port is connected to a corresponding radiator port of the first feed array, and the second output port is connected to a corresponding radiator port of the second feed array. The four port circuit produces low difference sidelobes by canceling out difference pattern contributions from the first radiating element of the first set and the first radiating element of the second set.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a block diagram of a four-port device in accordance with the invention.

FIG. 2 is a schematic diagram of a circuit implementation of the four-port device of FIG. 1.

FIG. 3 is an exploded view of an implementation of the four-port device of FIG. 1 in suspended stripline.

FIG. 4 is a simplified block diagram of a conventional corporate linear feed configuration with a simple monopulse network.

FIG. 5 illustrates the power distribution to the array radiating elements provided by the feed configuration of FIG. 4.

FIG. 6 illustrates the antenna patterns produced by the array feed configuration of FIG. 4.

FIG. 7 is a schematic block diagram showing the incorporation of the four-port device of FIG. 1 into the array feed configuration of FIG. 4 in accordance with the invention.

FIG. 8 illustrates the power distribution to the array radiating elements provided by the feed configuration of FIG. 7.

FIG. 9 illustrates the antenna patterns produced by the array feed configuration of FIG. 7.

FIG. 11 is a schematic block diagram of an alternate two-dimensional array incorporating the four-port device in the feed configuration in accordance with this invention.

FIG. 12 is a schematic block diagram of an alternate embodiment of a linear array including a plurality of the four-port devices of FIG. 1.

DETAILED DESCRIPTION OF THE PREFERRED EMBODIMENT

Figure 10:
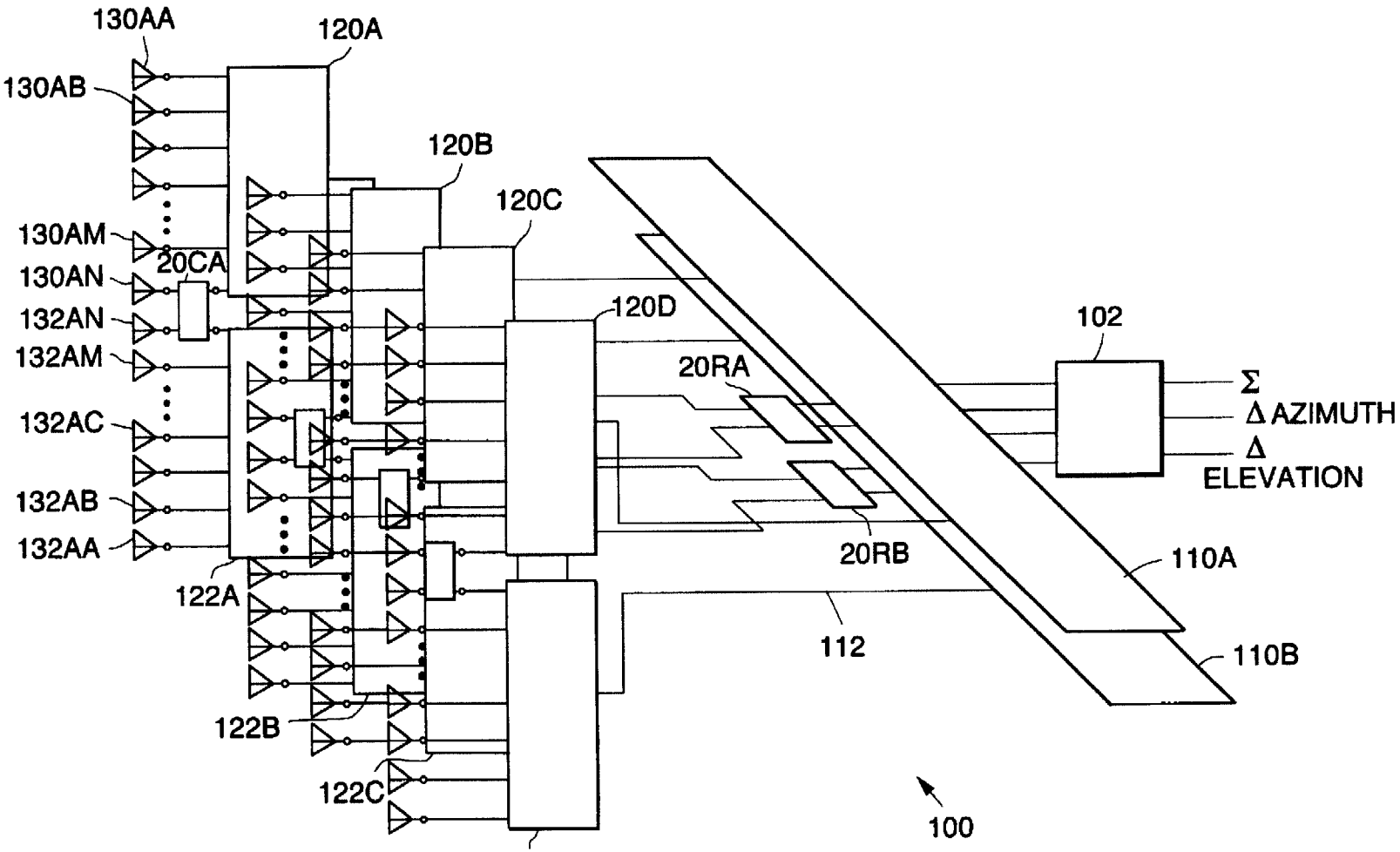
FIG. 10 is a schematic block diagram of a two-dimensional planar array incorporating the four-port device into the feed network.

According to one aspect of the invention, a four-port device is described that processes two incoming RF signals of arbitrary phase and amplitude to output two corresponding RF signals of equal phase and amplitude. When implemented into an antenna array excited with a matched corporate feed, the resulting assembly realizes simultaneous low sum and difference sidelobe antenna patterns. The device can be implemented into the corporate feed of the array with greater ease, lower cost and flexibility than can be achieved using known techniques. Moreover, the level of added complexity and performance degradation is minimal compared to known techniques.

FIG. 1 is a block diagram of a four-port device 20 in accordance with the invention, which has two input ports, 22 and 24, and two output ports, 32 and 34. Two signals of arbitrary phase and amplitude enter the two input ports, with the resulting signals at the two output ports having equal amplitude and phase. Thus, a first signal of amplitude A and phase $\theta_1$ enters port 22, and a second signal of amplitude B and phase $\theta_2$ enters port 24. The device converts the two input signals into two output signals of equal amplitude $A_3$ and phase $\theta_3$.

An exemplary circuit implementation of the device 20 is illustrated in the schematic diagram of FIG. 2. This is a circuit with two plane symmetry, i.e. it is symmetrical about a plane along the short circuit interconnect 48, and along an orthogonal plane bisecting the two resistors 26 and 36. A 100 ohm resistor 26 is connected across the two input ports 22 and 24. Similarly, a 100 ohm resistor 36 is connected across the two output ports. Two quarter wavelength transmission lines 40 and 44 are connected in series between the input port 22 and the output port 32. Similarly, two quarter wavelength transmission lines 42 and 46 are connected in series between the input port 24 and the output port 34. All the lines 40–46 have 50 ohm characteristic impedances. A short circuit interconnect 48 is made at junction A—A, between nodes 38A and 38B, each node at the series interconnection between two quarter wavelength transmission lines.

The value of the resistances 26 and 36 can be calculated using convention even/odd mode analysis, well known in the design of devices such as Wilkinson power dividers. Effectively, the short circuit presented by interconnect 48 located one quarter wavelength away from the input ports appears (at the input ports) as an open circuit. The resistances can be considered as two equal resistances in series connection, with a floating ground at the series connection, for purposes of the even/odd mode analysis. For the quarter-wavelength transmission line segments 40–46 of 50 ohm characteristic impedance, resistance values of 100 ohms are suitable.

The circuit of FIG. 2 has two plane symmetry, i.e. it is symmetrical about a plane along the short circuit interconnect 48, and along an orthogonal plane bisecting the two resistors 26 and 36.

As signals enter the two input ports, the two signals must combine into one resultant signal at the short circuited junction A—A. The resultant signal is the vector addition of the two signals entering the input ports. Thus, let the two RF signals entering the input ports 22 and 24 be described as vectors A and B such that $B=b_1u+b_2v$, and $A=a_1u+a_2v$, where u and v are orthogonal unit vectors. The combination of the two vectors at junction A—A will be $A+B=(a_1+b_1)u+(a_2+b_2)v$. Note that $|A+|$ can be less than or equal to $|A|+|B|$, depending on whether there exists out of phase components between A and B. Physically, the out of phase components resulting from A+B will be reflected back away from the junction A—A to be absorbed by the resistor 26. Thus, the 100 ohm resistors across the input and output ports will provide a good 50 ohm match at the ports and good isolation between the two input ports and between the two output ports. The remaining in-phase components resulting from A+B. will be divided into two output signals whose vectors are of equal amplitude and equal phase. The magnitude of the two output vectors is one half $|A+B|$. Since the two outputs are equal phase and amplitude, no voltage potential will exist at any corresponding points on the transmission lines 44 and 46 within the device. Thus the output pairs are unaffected by either the short circuit 48 or 100 ohm resistor 36 that connects across the transmission lines at the output ports. The resulting equal phase and equal amplitude outputs are important results of the functioning of device 20, and can be exploited when the device is integrated into the corporate feed of a linear or planar array.

Since the operation of the four-port device embodying the invention is symmetrical and reciprocal, its function is also reciprocal. There is no need or added benefit to perform any quarter-wave transmission line impedance transformations as in conventional planar matched power dividers or magic-Ts.

FIG. 3 is an exploded view of an exemplary implementation of the four-port device 20 in suspended stripline. The device can alternatively be fabricated in other transmission line media, including microstrip, coaxial, stripline or waveguide. The suspended stripline device 50 comprises upper and lower housings 52 and 54, each with a corresponding air channel 52A and 54A formed therein. A dielectric substrate 56 is sandwiched between the upper and lower housings 52 and 54, and has defined thereon a strip-line conductor pattern to define the four quarter wave transmission line segments and the short circuit Chip resistor elements are located on board the substrate 56 to serve the functions of resistors 26 and 36. The input/output ports 22, 24, 32, 34 are connected to respective coaxial connectors 60, 62, 64, 66.

FIG. 4 is a simplified block diagram of a conventional corporate linear feed configuration comprising array feed network 70A and 70B with a simple monopulse network 80. The array feed network 70A feeds radiating elements 90A–90M. The array feed network 70B feeds radiating elements 92A–92M. Assume that the feed configuration of FIG. 4 provides a power distribution to the array radiating elements as shown in FIG. 5 for the sum and difference channels. This array will produce antenna patterns as shown in FIG. 6.

Now assume that the four-port device 20 is incorporated into the array as shown in FIG. 7. The device 20 is connected so that port 22 is connected to radiating element 90M, port 24 is connected to radiating element 92M, port 32 is connected to a feed port of the array feed network 70A, and port 34 is connected to a feed port of the array feed network 70B. With the device 20 incorporated into the feed for the array, the power distribution along the difference channel is enhanced, as illustrated in FIG. 8, while the power distribution along the sum channel remains the same. The effect of the device 20 in the feed configuration is to cancel out the contributions of the center elements only in the difference distribution, when processed by the conventional monopulse network 80. The resulting distribution will produce antenna patterns with lower difference pattern sidelobes, as shown in FIG. 9, while the sum pattern remains the same.

The four-port device 20 of FIG. 1 can advantageously be incorporated into the feed network of a two-dimensional planar array, to produce antenna patterns with lower difference sidelobes while leaving the sum antenna patterns unchanged. The effect of the incorporation of the invention is to passively remove the contribution of the center radiating elements of the two-dimensional array from the distribution along the difference during monopulse processing.

FIG. 10 is a schematic block diagram of a two-dimensional planar array 100 incorporating the four-port device into the feed network. The array 100 includes a conventional monopulse network 102 which is connected to the array row feed networks 110A and 110B to provide the sum, Δazimuth and Δelevation channel signals. The output ports of the array row feed networks 110A and 110B are connected to corresponding ports of the top and bottom column feed networks 120A, 120B . . . , 122A, 122B . . . through transmission lines 112. The array column feed networks each includes ports connected to corresponding columns of the radiating elements of the array. Thus, for example, a first column of radiating elements is arranged in a top group of radiators 130AA–130AN and a bottom group of radiators 132AA–132AN. The top group of radiators 130AA–130AN is fed by array column feed 120A, and the bottom group of radiators is fed by bottom array column feed 122A.

In accordance with the invention, the array 100 incorporates the four-port phase and amplitude equalizer network 20 into the feed configuration. Each row feed and each column feed has associated therewith a corresponding four-port network 20. For the row feeds, the network 20 is connected to the two center ports, and to corresponding ports of a column feed. Thus, device 20RA has its output ports connected to the two center ports of the two center upper array column feed networks, and device 20RB has its output ports connected to the two center ports of the two center lower array column feed networks. Similarly, in the same manner illustrated in FIG. 7, each column feed network pair has associated therewith one of the four-port devices 20. For example, the center radiating elements 130AN and 132AN of a first column of radiating elements 130AA–130AN and 132AA–132AN are connected to the input ports of four-port device 20CA. The output ports of device 20CA are connected to ports of column feed networks 120A and 120B.

FIG. 11 is a schematic block diagram of an alternate two-dimensional array 150 incorporating the four-port device 20 in the feed configuration in accordance with this invention. The array 150 includes four conventional quadrant feed networks 160–166, which each have a combiner port connected by transmission lines 168 to a conventional monopulse network 170 for developing sum, Δazimuth and Δelevation channel signals. Each of the quadrant feed networks includes aperture interconnect ports for connection to corresponding radiating elements (not shown) in the respective corresponding quadrant. Four devices 20A–20D are connected together and to edge interconnects along adjoining edges of the quadrants. Thus, input ports of device 20B are connected to the adjoining edge interconnects 162A, 164A of feed networks 162 and 164. Input ports of device 20D are connected to the adjoining edge interconnects 160A, 166A of feed networks 160 and 166. An output port of each of devices 20D and 20B is respectively connected to input ports of device 20A. An output port of each of devices 20D and 20B is respectively connected to input ports of device 20C. The output ports of devices 20A and 20C are in turn respectively connected to aperture interconnects for connection to radiating elements located on the partitions between adjacent quadrants.

The use of the four-port device in array antenna feeds provides a simple and low cost technique to implement low sidelobe difference pattern capabilities in an array antenna. Other techniques require nonplanar routing of transmission lines and thus some modification of the feeds. In contrast, the device 20 can be incorporated in the array feed configuration while maintaining the integrity of the feeds without modification. Moreover, it is possible to further lower the difference sidelobes by further use of the four-port device, as shown in FIG. 12. The array of FIG. 12 is similar to that of FIG. 7, including the monopulse network 80, the array feed networks 70A, 70B, and the radiating elements 90A–90N and 92A–92N. However, the array of FIG. 12 employs a four-port device 20 and equal power dividers 94A and 94B. The output ports of device 20A are connected to corresponding ports of the feeds 70A and 70B, but its input ports are connected to respective output ports of devices 20B and 20C. The input ports of device 94A are connected to radiating elements 90M and 90N, respectively. The input ports of device 94B are connected to radiating elements 92M and 92N, respectively. The device 20 when connected in this manner affects two additional radiating elements, thus canceling out the contributions from two additional radiators in the difference distribution.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A four-port circuit for processing two incoming RF signals of arbitrary phase and amplitude to output two corresponding RF output signals of equal phase and amplitude, comprising:

first and second input ports for receiving respective first and second incoming RF signals of arbitrary phase and amplitude;

first and second output ports at which first and second output signals are provided;

first and second quarter-wavelength transmission line segments connected at a first junction node and in series between said first input port and said first output port;

third and fourth quarter-wavelength transmission line segments connected at a second junction node and in series between said second input port and said second output port; and a short circuit interconnect for electrically connecting together said first and second nodes, so that said input signals are combined at said interconnect, and wherein said combined input signals are divided into first and second signals of equal phase and amplitude which are propagated through said respective second and fourth transmission line segments to said first and second output ports.

2. The device of claim 1 further comprising:

a first load element connected between said first and second input ports; and a second load element connected between said first and second output ports.

3. The device of claim 2 wherein said first load element is a first resistor element, and said second load element is a second resistor element.

4. An antenna array for generating sum and difference monopulse patterns, comprising:

first and second sets of radiating elements, each set including a plurality of radiating elements;

first and a second array feed networks, said first feed network having a first feed output port and a plurality of first feed network radiator ports, said second feed network having a second feed output port and a plurality of second feed network radiator ports;

a monopulse network having sum and difference ports and first and second array feed connection ports, said first feed connection port connected to said first feed output port, said second feed connection port connected to said second feed output port; and a four-port circuit having a first input port connected to a first radiating element of said first set and a second input port connected to a second radiating element of said second set, for processing two incoming RF signals of arbitrary phase and amplitude at corresponding radiating elements of said first and second sets to output two corresponding RF output signals of equal phase and amplitude, the circuit further comprising first and second output ports at which first and second output signals are provided, said first output port connected to a corresponding radiator port of said first feed array, said second output port connected to a corresponding radiator port of said second feed array, wherein said four port circuit comprises:

(i) first and second quarter-wavelength transmission line segments connected at a first junction node and in series between said first input port and said first output port, (ii) third and fourth quarter-wavelength transmission line segments connected at a second junction node and in series between said second input port and said second output port, and (iii) a short circuit interconnect for electrically connecting together said first and second nodes, so that said input signals are combined at said interconnect, and wherein said combined input signals are divided into first and second signals of equal phase and amplitude which are propagated through said respective second and fourth transmission line segments to said first and second output ports.

5. The array of claim 4 wherein said four port circuit further includes a first load element connected across said first and second input ports, and a second load element connected across said first and second output ports.

6. The array of claim 4 wherein said first and second sets of radiating elements are arranged in a linear array, disposed in a mirror image configuration about an array axis, such that said first radiating element of said first array is disposed adjacent said axis and said first radiating element of said second array is disposed adjacent said axis and adjacent said first radiating element of said first set.

7. The array of claim 4 wherein said four port circuit produces low difference sidelobes by canceling out difference pattern contributions from said first radiating element of said first set and said first radiating element of said second set.

8. A planar antenna array, comprising:

a plurality of radiating elements arranged in rows and columns over an array aperture, each column comprising an upper set of radiators and a lower set of radiators;

a monopulse network for developing a sum channel signal representing the sum of signal contributions from the radiating elements, a difference azimuth channel representing a first difference between respective contributions from an upper set of rows of radiating elements and a lower set of rows of radiating elements, and a difference elevation channel representing a second difference between a first set of contiguous columns of radiating elements and a second set of contiguous columns of radiating elements;

first and second array row feed networks each having a row output port connected to said monopulse network and a plurality of input ports corresponding in number to the number of columns;

a plurality of array column feed networks, each comprising an upper array column feed network and a lower column feed network, each of said upper and lower feed networks having a plurality of input ports and an output port;

a plurality of four port circuits, each circuit having first and second input ports and first and second output ports, each circuit for processing two incoming RF signals of arbitrary phase and amplitude at corresponding radiating elements of said first and second sets to output two corresponding RF output signals of equal phase and amplitude at said first and second output ports;

said plurality of four port circuits including one circuit corresponding to each column of radiating elements, connected between adjacent radiator elements of said upper and lower sets of radiators and corresponding input ports of said upper and lower column feed networks;

said plurality of four port circuits including a first row circuit connected between said output ports of two center upper column feed networks and between two center input ports of said first row array feed circuit;

said plurality of four port circuits including a second row circuit connected between said output ports of two center lower column feed networks and between two center input ports of said second row array feed circuit.

9. The array of claim 8 wherein said four port device comprises:

first and second quarter-wavelength transmission line segments connected at a first junction node and in series between said first input port and said first output port;

third and fourth quarter-wavelength transmission line segments connected at a second junction node and in series between said second input port and said second output port; and a short circuit interconnect for electrically connecting together said first and second nodes, so that said input signals are combined at said interconnect, and wherein said combined input signals are divided into first and second signals of equal phase and amplitude which are propagated through said respective second and fourth transmission line segments to said first and second output ports.

10. The array of claim 9 wherein said four port circuit further includes a first load element connected across said first and second input ports, and a second load element connected across said first and second output ports.

11. The array of claim 8 wherein said four port circuits produces low difference sidelobes.

12. A planar antenna array, comprising:

a plurality of radiating elements arranged in quadrants, and comprising first, second, third and fourth quadrant sets of radiators;

a monopulse network for developing a sum channel signal representing the sum of signal contributions from the radiating elements, a difference azimuth channel, and a difference elevation channel;

first second, third and fourth quadrant feed networks each having a plurality of input ports equal in number to the number of radiating elements in the corresponding quadrant set, and an output port, each of the output ports connected to input ports of said monopulse network;

a plurality of four port circuits, each circuit having first and second input ports and first and second output ports, each circuit for processing two incoming RF signals of arbitrary phase and amplitude at corresponding radiating elements of said first and second sets to output two corresponding RF output signals of equal phase and amplitude at said first and second output ports;

said plurality of four port circuits including a first circuit having its first input port connected to a radiator of said first quadrant and its second input port connected to a radiator of said second quadrant, a second circuit having its first input port connected to a radiator of said third quadrant and its second input port connected to a radiator of said fourth quadrant, a third circuit having its first output port connected to an input port of said first quadrant feed network and its second output port connected to an input port of said third quadrant feed network, and a fourth circuit having its first output port connected to an input port of said second quadrant feed network and its second output port connected to an input port of said fourth quadrant feed network;

and wherein the first output port of said first circuit is connected to a first input port of said third circuit, said second output port of said first circuit is connected to a first input port of said fourth circuit, the first output port of said second circuit is connected to a second input port of said third circuit, and the second output port of said second circuit is connected to a second input port of said fourth circuit.

13. The array of claim 12 wherein said four port device comprises:

first and second quarter-wavelength transmission line segments connected at a first junction node and in series between said first input port and said first output port;

third and fourth quarter-wavelength transmission line segments connected at a second junction node and in series between said second input port and said second output port; and a short circuit interconnect for electrically connecting together said first and second nodes, so that said input signals are combined at said interconnect, and wherein said combined input signals are divided into first and second signals of equal phase and amplitude which are propagated through said respective second and fourth transmission line segments to said first and second output ports.

14. The array of claim 13 wherein said four port circuit further includes a first load element connected across said first and second input ports, and a second load element connected across said first and second output ports.

15. The array of claim 12 wherein said four port circuits produces low difference sidelobes.

16. An antenna array for generating sum and difference mortpulse patterns, comprising:

first and second sets of radiating elements, each set including a plurality of radiating elements;

first and second array feed networks, said first feed network having a first feed output port and a plurality of first feed network radiator ports, said second feed network having a second feed output port and a plurality of second feed network radiator ports;

a monopulse network having sum and difference ports and first and second array feed connection ports, said first feed connection port connected to said first feed output port, said second feed connection port connected to said second feed output port; and a four-port circuit having a first input port coupled to first and second radiating elements of said first set through a first power combining circuit and a second input port connected to first and second radiating elements of said second set through a second power combing circuit, for processing two incoming RF signals of arbitrary phase and amplitude at said first and second input ports to output two corresponding RF output signals of equal phase and amplitude, the circuit further comprising first and second output ports at which first and second output signals are provided, said first output port connected to a corresponding radiator port of said first feed array, said second output port connected to a corresponding radiator port of said second feed array wherein said four-port circuit comprises:

(i) first and second quarter-wavelength transmission line segments connected at a first junction node and in series between said first input port and said first output port, (ii) third and fourth quarter-wave length transmission line segments connected at a second junction node and in series between said second input port and said second output port, and (iii) a short circuit interconnect for electrically connecting together said first and second nodes so that said input signals are combined at said interconnect, and wherein said combined input signals are divided into first and second signals of equal phase and amplitude which are propagated through said respective second and fourth transmission line segments to said first and second output ports.

17. The array of claim 16 wherein said four port circuit further includes a first load element connected across said first and second input ports, and a second load element connected across said first and second output ports.

18. The array of claim 16 wherein said first and second sets of radiating elements are arranged in a linear array, disposed in a mirror image configuration about an array axis, such that said first and second radiating elements of said first array are disposed adjacent said axis and said first and second radiating elements of said second array are disposed adjacent said axis and adjacent said first and second radiating elements of said first set.

19. The array of claim 16 wherein said four port circuit produces low difference sidelobes by canceling out difference pattern contributions from said first and second radiating elements of said first set and said first and second radiating elements of said second set.

* * * * *